US006946825B2

(12) United States Patent
Tesi

(10) Patent No.: US 6,946,825 B2
(45) Date of Patent: Sep. 20, 2005

(54) BANDGAP VOLTAGE GENERATOR WITH A BIPOLAR ASSEMBLY AND A MIRROR ASSEMBLY

(75) Inventor: Davide Tesi, Ferney-Voltaire (IT)

(73) Assignee: STMicroelectronics S.A., Montrouge (FR)

( * ) Notice: Subject to any disclaimer, the term of this patent is extended or adjusted under 35 U.S.C. 154(b) by 9 days.

(21) Appl. No.: 10/682,702

(22) Filed: Oct. 9, 2003

(65) Prior Publication Data

US 2004/0075487 A1 Apr. 22, 2004

(30) Foreign Application Priority Data

Oct. 9, 2002 (FR) ..... 02 12553

(51) Int. Cl.[7] ..... G05F 3/16
(52) U.S. Cl. ..... 323/313; 323/315; 323/316
(58) Field of Search ..... 323/313, 314, 323/315, 316

(56) References Cited

U.S. PATENT DOCUMENTS

| | | | | |
|---|---|---|---|---|
| 4,317,054 A | * | 2/1982 | Caruso et al. | 327/539 |
| 4,399,399 A | * | 8/1983 | Joseph | 323/315 |
| 4,506,208 A | * | 3/1985 | Nagano | 323/314 |
| 5,153,500 A | | 10/1992 | Yamamoto et al. | |
| 5,304,861 A | | 4/1994 | Fruhauf et al. | |
| 5,309,083 A | * | 5/1994 | Pierret et al. | 323/313 |
| 5,471,131 A | | 11/1995 | King et al. | |
| 5,485,127 A | | 1/1996 | Bertoluzzi et al. | |
| 5,629,611 A | | 5/1997 | McIntyre | |
| 5,646,518 A | * | 7/1997 | Lakshmikumar et al. | 323/316 |
| 5,680,037 A | * | 10/1997 | Carobolante | 323/315 |
| 5,847,556 A | * | 12/1998 | Kothandaraman et al. | 323/315 |
| 5,900,773 A | | 5/1999 | Susak | |
| 6,255,891 B1 | | 7/2001 | Matsuno et al. | |
| 6,351,110 B1 | * | 2/2002 | Pappalardo et al. | 323/285 |
| 6,377,110 B1 | | 4/2002 | Cooper | |
| 6,489,831 B1 | | 12/2002 | Matranga et al. | |
| 2002/0022941 A1 | | 2/2002 | Yin | |

OTHER PUBLICATIONS

French Search Report from French Patent Application No. 02/12553, filed Oct. 9, 2002.

Weng M–C et al.: "Low Cost CMOS On–Chip And Remote Temperature Sensors" IEICE Transactions On Electronics, Institute of Electronics Information And Comm. Eng. Tokyo, JP vol. E84–C, No. 4, Apr. 1, 2001, pp. 451–459, XP001005886; ISSN: 0916–8524.

Riedijk F. R. et al.: "An Integrated Absolute Temperature Sensor With Sigma–Delta A–D Conversion" Sensors And Actuators A, Elsevier Sequoia S.A., Lausanne, CH, vol. A34, No. 3, Sep. 1, 1992, pp. 249–256, XP000319955; ISSN: 0924–4247.

* cited by examiner

*Primary Examiner*—Bao Q. Vu
(74) *Attorney, Agent, or Firm*—Lisa K. Jorgenson; James H. Morris; Wolf, Greenfield & Sacks, P.C.

(57) ABSTRACT

A circuit for generating a reference voltage of bandgap type. The circuit includes a current mirror assembly of cascode type including, from a high supply rail, at least two parallel branches of P-channel MOS transistors. The circuit also includes a bipolar assembly in series with one of the branches of the mirror assembly down to a low supply rail, formed of two parallel branches each including, in series, a diode-connected bipolar transistor and, respectively, one resistor and two resistors. The circuit also includes a differential amplifier for balancing the currents in the two branches of the bipolar assembly, the reference voltage being provided by the terminal of interconnection of the mirror assembly with the bipolar assembly.

17 Claims, 2 Drawing Sheets

BANDGAP VOLTAGE GENERATOR WITH A BIPOLAR ASSEMBLY AND A MIRROR ASSEMBLY

BACKGROUND OF THE INVENTION

Field of the Invention

The present invention relates to the field of reference voltage generators and, more specifically, to the forming of a bandgap voltage generator. Such a generator is used to generate a reference voltage which is steady in temperature and in supply voltage. The present invention also aims at providing such a reference voltage generator which is not sensitive to possible technological mismatches of the transistors forming it.

Another object of the present invention is to share such a reference voltage generator for the provision of a reference voltage of an analog-to-digital converter and of a voltage depending on the internal temperature of an integrated circuit in which the generator is formed, to form an integrated digital sensor of the internal temperature of a circuit.

SUMMARY OF THE INVENTION

To achieve these and other objects, the present invention provides a circuit for generating a bandgap reference voltage, comprising:

a current mirror assembly of cascode type comprising, from a high supply rail, at least two parallel branches of P-channel MOS transistors;

a bipolar assembly in series with one of said branches of the mirror assembly down to a low supply rail, formed of two parallel branches, each comprising, in series, a diode-connected bipolar transistor and, respectively, one resistor and two resistors; and a differential amplifier for balancing the currents in the two branches of the bipolar assembly, the reference voltage being provided by the terminal of interconnection of the mirror assembly with the bipolar assembly.

According to an embodiment of the present invention, said mirror assembly comprises:

a first branch formed of two series diode-connected transistors; and a second branch formed of two transistors in series having their respective gates connected to the respective gates of the two transistors of the first branch, the second branch forming said branch in series with the bipolar assembly.

According to an embodiment of the present invention, the respective inputs of the differential amplifier are connected to the respective branches of the bipolar assembly, its output being connected to the terminal of the first branch of the cascode assembly, opposite to the terminal connected to the high supply rail.

According to an embodiment of the present invention, the four MOS transistors of the cascode assembly have identical sizes.

According to an embodiment of the present invention, the resistor of the first branch of the bipolar assembly is of same value as a first resistor of the second branch which has a common terminal with the resistor of the first branch, the bipolar transistor connected in series with the two resistors being of greater size than the other bipolar transistor.

According to an embodiment of the present invention, the mirror assembly comprises a third branch formed of two P-channel MOS transistors in series with a current-to-voltage conversion resistor between said high and low supply rails, the voltage across said conversion resistor being directly proportional to the internal temperature of the integrated circuit.

According to an embodiment of the present invention, the respective gates of these two MOS transistors of the third branch are connected to the respective gates of the two MOS transistors of the first branch.

The present invention also provides an integrated digital temperature sensor, comprising:

a circuit for generating a reference voltage and a voltage proportional to the internal temperature;

a calibration circuit exploiting the reference voltage and the voltage proportional to temperature, to provide two voltages representative of high and low conversion thresholds, and an analog voltage representing the current temperature; and an analog-to-digital converter receiving the three voltages provided by the calibration circuit, and providing a binary word representative of the internal circuit temperature.

According to an embodiment of the present invention, said voltage representative of the low conversion threshold is formed by the reference voltage.

According to an embodiment of the present invention, the output of the analog-to-digital converter is connected to the input of a register for storing the digital temperature.

The foregoing objects, features, and advantages of the present invention will be discussed in detail in the following non-limiting description of specific embodiments in connection with the accompanying drawings.

DETAILED DESCRIPTION

Figure 1:
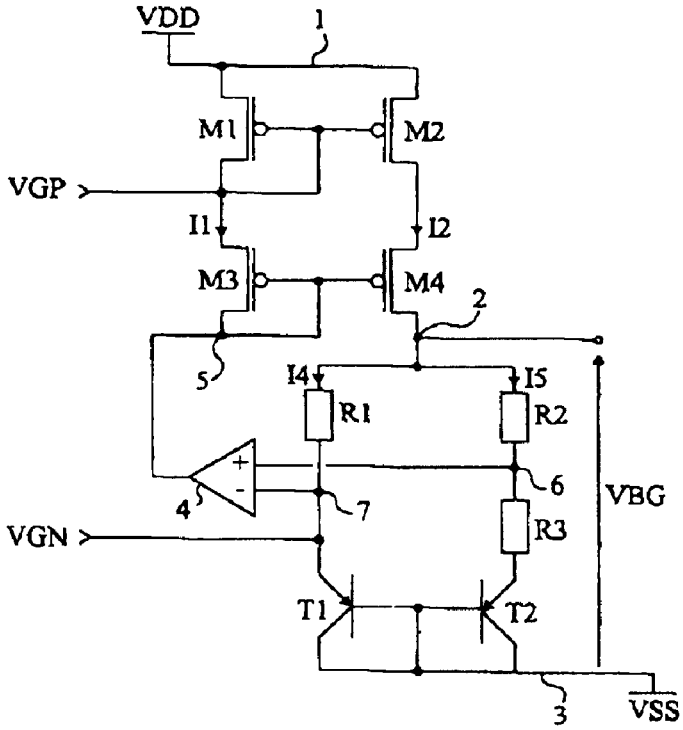
FIG. 1 shows the electric diagram of a voltage generator of bandgap type according to an embodiment of the present invention.

The same elements have been designated with the same reference numerals in the different drawings. For clarity, only those circuit components that are necessary to the understanding of the present invention have been shown in the drawings and will be described hereafter. In particular, the structure of an analog-to-digital converter has not been detailed and may be implemented with any known analog-to-digital converter in its example of application to a digital temperature sensor. Further, the structure of the operational amplifiers has not been detailed, this structure being conventional and within the abilities of those skilled in the art, the present invention being implementable with any conventional type of amplifier.

The circuit for generating a reference voltage $V_{BG}$ of bandgap type, illustrated in FIG. 1, comprises a current mirror in a so-called cascode-type assembly comprising two parallel branches each having two P-channel MOS transistors. A first branch comprises two transistors M1 and M3 in series, the source of transistor M1 being connected to a rail 1 of positive supply $V_{DD}$. Transistors M1 and M3 are diode-connected, their respective gate and drain being interconnected. The second branch comprises two P-channel MOS transistors M2 and M4 in series between high supply rail 1 and an output terminal 2 of the circuit providing voltage $V_{BG}$. The respective gates of transistors M2 and M4 are connected to the gates of transistors M1 and M3, respectively. Transistors M1 and M2 are mirror-connected, as well as transistors M3 and M4, and transistors M1 to M4 all have the same size.

To obtain a stable reference voltage $V_{BG}$, the respective currents I1 and I2 in the two branches of the cascode assembly must be identical. To obtain this identity, an assembly based on diode-connected bipolar transistors between terminal 2 and a rail 3 of reference supply ($V_{SS}$) is used according to the present invention. This assembly is formed of two parallel branches between terminals 2 and 3. A first branch comprises a resistor R1 in series with a PNP-type bipolar transistor T1, the emitter of transistor T1 being connected to resistor R1. The second branch comprises the series assembly of two resistors R2 and R3 and of a PNP-type bipolar transistor T2 connected, like transistor T1, as a diode, its base and collector being interconnected to rail 3 and its emitter being connected to resistor R3. Transistors T1 and T2 are selected to have different sizes, transistor T2 for example having an emitter surface area greater than that of transistor T1.

According to the present invention, a differential amplifier 4 is reverse-feedback connected between terminal 2 and drain 5 of transistor M3. More specifically, the output of operational amplifier 4 is connected to drain 5 of transistor M3 while its respective non-inverting and inverting inputs are connected to junction point 6 of resistors R2 and R3 and to junction point 7 of resistor R1 and transistor T1.

Finally, the gates of transistors M1 and M2 receive an activation voltage $V_{GP}$, and the inverting input of amplifier 4 receives an activation voltage $V_{GN}$. Signals $V_{GP}$ and $V_{GN}$ are provided by a circuit which will be described subsequently in relation with FIG. 2. They are used to activate the generator shown in FIG. 1 by properly biasing its transistors.

The operation of the voltage generator of FIG. 1 is the following.

Since transistors M1 and M2 have the same gate-source voltage, their respective drain voltages are identical. Currents I1 and I2 that they conduct are thus also the same.

Further, since resistors R1 and R2 have the same value, the slightest drift between currents I4 and I5 running in both branches of the bipolar transistor assembly is compensated for, due to operational amplifier 4, by a variation in the voltage at node 5, which balances back currents I4 and I5 as being exactly half the value of current I2.

As a first approximation, the symmetry between currents I4 and I5 only depends on the possible dispersion between resistors R1 and R2.

One may thus write, expressing the respective currents running through transistors T1 and T2:

$$I_s \cdot \exp\left(\frac{q \cdot V_{BE1}}{n \cdot k \cdot T}\right) = A \cdot I_s \cdot \exp\left(\frac{q \cdot V_{BE2}}{n \cdot k \cdot T}\right),$$

where $V_{BE1}$ and $V_{BE2}$ designate the respective base-emitter voltages of transistors T1 and T2;

q designates the charge of the electron;

k designates Bolzmann's constant;

T designates the circuit temperature;

Is designates the saturation current of transistors T1 and T2, which are assumed to be identical;

A designates the size ratio between transistors T2 and T1; and n designates the ideality factor of the transistors, which is considered as being identical for transistors formed on a same integrated circuit.

The following can be deduced from the foregoing relation:

$$\Delta V_{BE} = V_{BE1} - V_{BE2} = \frac{n \cdot k \cdot T}{q} \cdot \ln(A).$$

Voltage $V_{BG}$ is then provided by the following relation:

$$V_{BG} = \frac{\Delta V_{BE}}{R3} \cdot R1 + V_{BE1}.$$

The reference voltage generator of FIG. 1 effectively is stable in temperature. Indeed, voltage $V_{BE1}$ has, it being a PNP-type transistor, a negative temperature coefficient, that is, it decreases as the temperature increases. However, voltage difference $\Delta V_{BE}$ varies proportionally to temperature and with a positive coefficient, that is, it increases along with temperature. Accordingly, the variations compensate for each other in their influence upon voltage $V_{BG}$.

Further, the provided voltage $V_{BG}$ is stable against possible variations of the supply voltage. Indeed, it is independent from the values of the currents flowing through the assembly branches.

Figure 2:
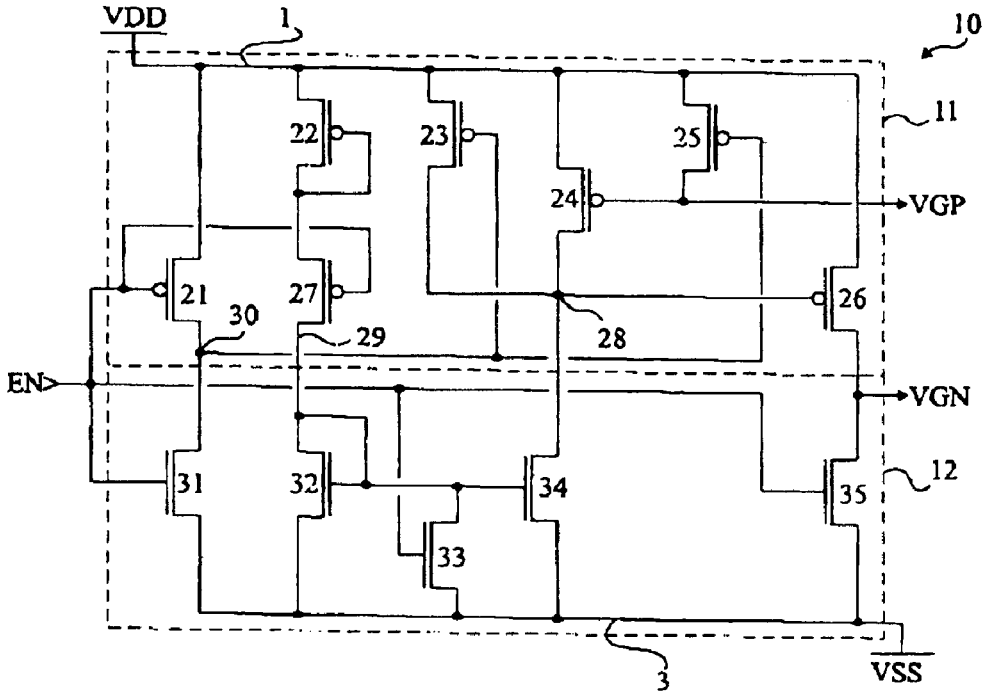
FIG. 2 shows an embodiment of a circuit for activating the voltage generator of FIG. 1.

FIG. 2 shows an embodiment of a circuit 10 for activating the MOS transistors of the cascode mirror of FIG. 1 and, more generally, of the different MOS transistor assemblies of the integrated circuit containing the generator of FIG. 1. In particular, operational amplifier 4 of the bandgap generator comprises transistors which are also activated by signals $V_{GP}$ and $V_{GN}$, as for a conventional circuit.

Circuit 10 comprises a first stage 11 of P-channel MOS transistors and a second stage 12 of N-channel MOS transistors between high 1 and low 3 supply rails. The two stages 11 and 12 receive a same control signal EN and each respectively provides voltage $V_{GP}$ and $V_{GN}$ of activation of the transistors of the circuit of FIG. 1.

Stage 11 comprises six P-channel MOS transistors 21 to 26 having their source and their bulk connected to high supply $V_{DD}$. The gate of transistor 24 and the drain of transistor 25 form the output terminal providing signal $V_{GP}$ of circuit 10. The drain of transistor 21 is connected to the gate of transistors 23 and 25. The gate of transistor 21 is connected to the gate of a seventh P-channel MOS transistor 27 series-connected with transistor 22, its source being connected to the drain and to the gate of diode-connected transistor 22. The respective gates of transistors 21 and 27 receive signal EN. The drains of transistors 23 and 24 are interconnected to the gate of transistor 26 and form a terminal 28 of connection to second stage 12. The bulk of transistor 27 is connected to high supply $V_{DD}$. Its drain forms a second terminal 29 of connection to the second stage while the drain of transistor 21 forms a third terminal 30 of connection to the second stage.

Stage 12 of the N-channel transistors comprises five MOS transistors 31 to 35 having all their sources connected to reference supply rail $V_{SS}$. The gates of transistors 31, 32, and 35 are connected to the input terminal providing signal EN. The drain of transistor 31 is connected to the drain of transistor 21 (terminal 30). The gates of transistors 32 and 34 are interconnected to the drains of transistors 33 and 32 (and thus to terminal 29). The drain of transistor 34 is connected to terminal 28 while the drain of transistor 35 is connected to the drain of transistor 26 of stage 11 and forms the terminal of provision of output voltage $V_{GN}$.

In the idle state, when the transistors of the generator of FIG. 1 need not be biased, signal EN is high (for example, at voltage $V_{DD}$). In this state, transistors 23, 25, 31, 33, and 35 of the circuit of FIG. 2 are on, transistors 21, 22, 24, 26, 27, 32, and 34 being off. As a result, signal $V_{GN}$ is low (voltage $V_{SS}$) while signal $V_{GP}$ is high. Accordingly, the transistors of the current mirror of FIG. 1 are off.

Upon activation of the circuit by a low setting (to a voltage close to $V_{SS}$) of input EN, transistors 21, 22, 24, 26, 27, 32, and 34 turn on, while transistors 23, 25, 31, 33, and 35 turn off. In fact, the voltage at initially-discharged node D22 (drain of transistor 22) starts increasing. The same occurs for the voltage at node 29 since no current flows any more through the branch formed of transistors 22, 27, and 32. The turning-on of transistor 34 turns on transistor 26. A current starts flowing from rail 1 to node 7 (FIG. 1). This turns on the mirror-connected transistors of FIG. 1. In steady state, the current flowing through the branch formed of transistors 22, 27, and 32 is identical to the current in the branch formed of transistors 24 and 34 by the mirror assembly of transistors 32 and 34. This current is much smaller than current 12 (FIG. 1). The transistors of the assembly of FIG. 2 are sized so that, in this steady state, the voltage at node 28 is greater than the threshold voltage of transistor 26 to stop the flowing of the starting current to the generator of FIG. 1, which would otherwise adversely affect the operation of its current mirror.

Figure 3:
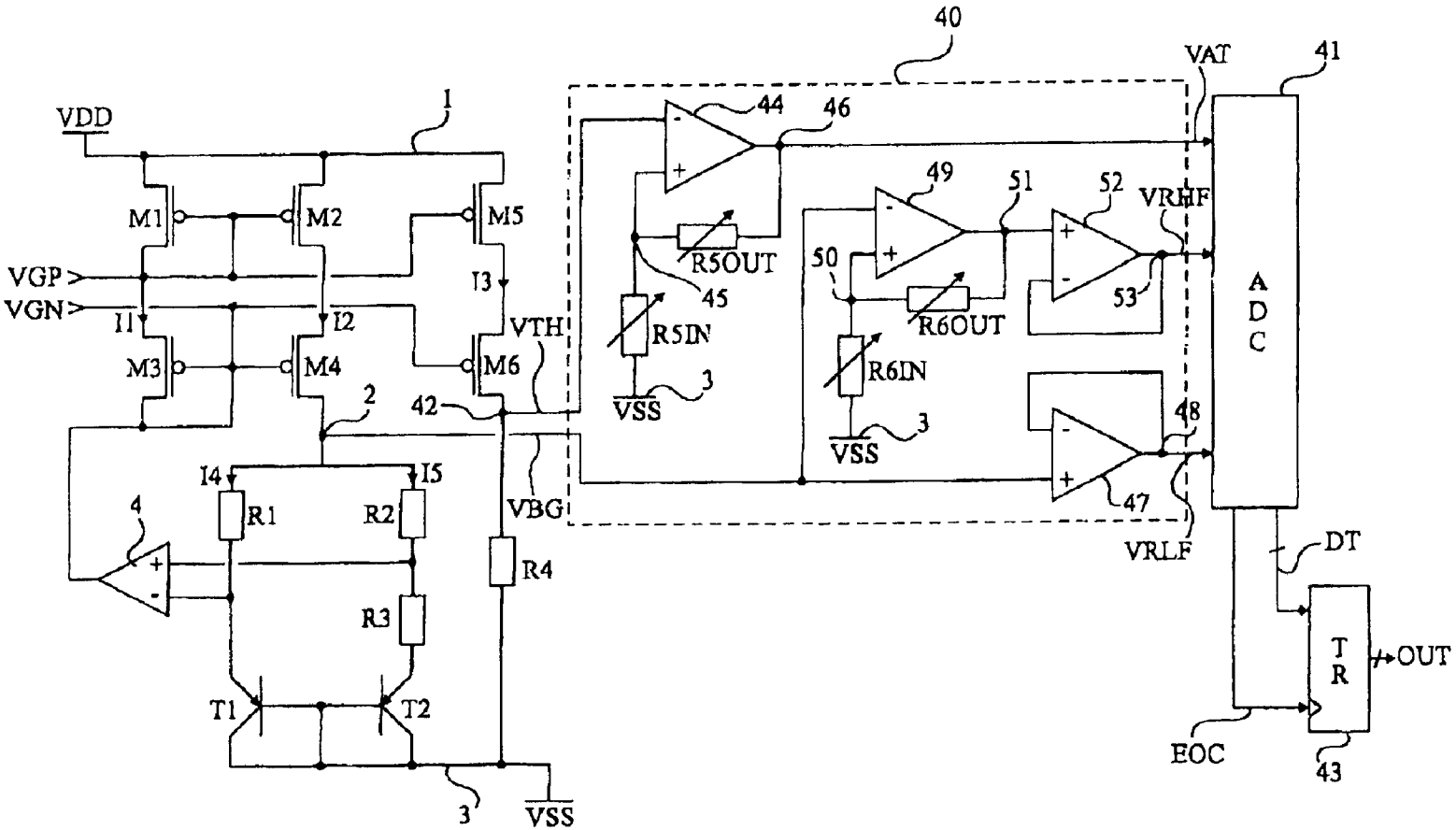
FIG. 3 schematically shows an embodiment of an integrated digital temperature sensor, using a reference generator such as illustrated in FIG. 1.

FIG. 3 shows a preferred example of application of the circuit of FIG. 1 to the generation of a reference voltage $V_{BG}$ intended to be used by a circuit 40 for calibrating an analog-to-digital converter 41 (ADC) of an integrated temperature sensor of a circuit.

According to this preferred example, the cascode current mirror of FIG. 1 is also used to provide a voltage $V_{TH}$ depending on the internal temperature of the circuit and more specifically, of the silicon on which it is integrated. For this purpose, a third branch formed of two P-channel MOS transistors M5 and M6 mirror-connected on transistors M1 and M3 is provided, the respective gates of transistors M5 and M6 being connected to the respective gates of transistors M1 and M3. The source of transistor M5 is connected to high supply rail 1 while its drain is connected to the source of transistor M6, the drain of which forms a terminal 42 for providing voltage $V_{TH}$, connected by a resistor R4 to low supply rail 3.

Since current 13 flowing through the first branch of the assembly is equal to current I2 and resistors R1 and R2 are of same values, current I5 flowing through the second branch of the bipolar assembly is half current I2. One may thus write:

$$I3 = \frac{2 \cdot \Delta V_{BE}}{R3} = \frac{2}{R3} \cdot \frac{n \cdot k \cdot T}{q} \cdot \ln(A)$$

Accordingly, voltage $V_{TH}$ may be written as:

$$V_{TH} = R4 \cdot I3 = \frac{2 \cdot R4}{R3} \cdot \frac{n \cdot k \cdot T}{q} \cdot \ln(A)$$

The only unknown in the above equation is the possible error on ratio R4/R3 with respect to their nominal values. This error can be evaluated as follows:

$$\frac{\Delta\left(\frac{R4}{R3}\right)}{\frac{R4}{R3}} = \frac{\Delta R4}{R4} - \frac{\Delta R3}{R3}.$$

The difference between the error rates on the values of R4 and of R3 can be considered as negligible assuming that both resistors have the same value and the same design (size and pattern on the integrated circuit). The only error source thus is the possible mismatch between resistors.

According to the embodiment of FIG. 3, voltage $V_{TH}$ is intended to be converted by converter 41 to provide a digital word DT representative of the integrated circuit temperature. Word DT is, for example, provided to the data input of a register 43 (TR) for storing this temperature and the clock input of which receives a signal EOC indicative of the end of the conversion, generally present on any analog-to-digital converter. Output OUT of register 43 provides the recorded temperature.

The function of calibration circuit 40 is to amplify signal $V_{TH}$ into an analog signal $V_{AT}$ acceptable at the input of converter 41 and to set two thresholds $V_{RLF}$ and $V_{RHF}$ defining the conversion range of the converter, that is, an analog voltage $V_{RLF}$ for which converter 41 provides a signal DT only comprised of bits at zero and an analog voltage $V_{RHF}$ for which converter 41 only provides bits at one. Low threshold $V_{RLF}$ of converter 41 preferentially corresponds to reference voltage $V_{BG}$.

Circuit 40 forms, in a way, an analog interface for the inputs of converter 41 so that the low-impedance input of the converter does not affect the measured voltage which must remain temperature-dependent. Levels $V_{RLF}$ and $V_{RHF}$ correspond to the respective possible maximum and minimum levels of analog voltage $V_{AT}$ provided to the converter, that is, $B.V_{TH}$, where B represent the amplification performed on the measured analog voltage.

In the embodiment of FIG. 3, it is assumed that level $V_{BG}$ directly forms low conversion threshold $V_{RLF}$ of converter 3. Circuit 40 then only adapts the impedance of voltage level $V_{BG}$, by means of a follower-connected operational amplifier 47 (its inverting input being looped back on output 48) which provides level $V_{RLF}$, and the non-inverting input of which receives voltage $V_{BG}$ of the measurement circuit.

Threshold $V_{RHF}$ is set, based on voltage $V_{BG}$, by means of an operational amplifier 49 having a non-inverting input connected to midpoint 50 of a resistive dividing bridge formed of two resistors R6OUT and R6IN in series between output 51 of amplifier 49 and reference supply voltage $V_{SS}$. Resistances R6IN and R6OUT are adjustable to set the amplification ratio of amplifier 49 and, accordingly, the maximum high conversion level $V_{RHF}$, in stable fashion with respect to voltage $V_{BG}$. For impedance matching needs, output 51 of amplifier 49 is connected to the input of a follower-connected operational amplifier 52 which provides threshold $V_{RHF}$ to converter 41, the inverting input of amplifier 52 being connected to its output 53 while its non-inverting input is connected to terminal 51.

As for voltage $V_{AT}$, it is calibrated by means of an operational amplifier 44 having its inverting input receiving the measured analog level $V_{TH}$ and having its noninverting input connected to the midpoint 45 of a resistive dividing bridge formed of the series association of resistors R5OUT and R5IN between output terminal 46 of amplifier 45 and reference voltage $V_{SS}$. Terminal 46 forms the output terminal of circuit 40 providing voltage $V_{AT}$ to be converted by converter 41. Resistors R5IN and R5OUT set amplification ratio B.

The calibration of the system by means of circuit 40 consists of submitting the circuit to a temperature corresponding to the minimum threshold (for example, −40° C.) by means of an external cold source. Resistances R5IN and R5OUT are then adjusted for level $V_{TH}$ provided by circuit 40 to correspond to level $V_{BG}$ (that is, level $V_{RLF}$). This adjustment may be performed either by comparing analog voltages $V_{TH}$ and $V_{RLF}$, or by reading the output of converter 41, all the bits of which must be at 0 when voltage $V_{TH}$ corresponds to the minimum level of the conversion scale.

The integrated circuit is then submitted to a temperature corresponding to the maximum temperature of the conversion range (for example, +125° C.), still by means of an external source. Resistances R6IN and R6OUT are then adjusted until voltage $V_{RHF}$ is equal to the measured voltage $V_{TH}$. Like for the preceding step, either analog levels $V_{TH}$ and $V_{RHF}$ may be compared, or the output of converter 41 may be examined, all its bits then having to be at state 1.

For each of amplifiers 44 and 49, if the output level is too high with respect to the desired level, either the input resistance (R5IN, respectively R6IN) may be increased, or the feedback resistance (R5OUT, respectively R6OUT) may be decreased. If the output level is too low, the inverse operation is performed, that is, the input resistance is decreased or the feedback resistance is decreased.

The analog-to-digital converter used may be any conventional converter providing an output over a number of bits selected according to the resolution desired for the sensor. If need be, the converter inputs/outputs are associated with level-shifting circuits (not shown) for the case where the respective supply voltages of the sensor and of the converter are not compatible with each other.

An advantage of the present invention is that it enables forming a bandgap-type voltage reference generator of simple structure.

Another advantage of the present invention is that the provided generator is particular well adapted to the generation of a voltage depending on the internal circuit temperature, which can then be converted into a digital word. In this application, the present invention has the advantage of providing a fully-integrated digital temperature sensor.

Of course, the present invention is likely to have various alterations, modifications, and improvements which will readily occur to those skilled in the art. In particular, the choice of the respective sizes of the different transistors as well as of the resistors is within the abilities of those skilled in the art based on the functional indications given hereabove and on the application, especially on the desired temperature operating ranges.

Further, although the present invention has been more specifically described in relation with an example of application to an integrated digital temperature sensor, it more generally applies anywhere a reference voltage stable in temperature and in supply voltage is desired, that is, in any circuit using a bandgap-type voltage. For example, digital-to-analog converters, phase-locked loops (PLLs), etc.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A circuit for generating a bandgap reference voltage, comprising:

a current mirror assembly of cascode type comprising, from a high supply rail, at least two parallel branches of P-channel MOS transistors;

a bipolar assembly in series with one of said branches of the mirror assembly down to a low supply rail, formed of two parallel branches, each comprising, in series, a diode-connected bipolar transistor and, respectively, one resistor and two resistors; and a differential amplifier for balancing the currents in the two branches of the bipolar assembly, the reference voltage being provided by the terminal of interconnection of the mirror assembly with the bipolar assembly.

2. The circuit of claim 1, wherein said mirror assembly comprises:

a first branch formed of two series diode-connected transistors; and a second branch formed of two transistors in series having their respective gates connected to the respective gates of the two transistors of the first branch, the second branch forming said branch in series with the bipolar assembly.

3. The circuit of claim 2, wherein the respective inputs of the differential amplifier are connected to the respective branches of the bipolar assembly, its output being connected to the terminal of the first branch of the cascode assembly, opposite to the terminal connected to the high supply rail.

4. The circuit of claim 2, wherein the four MOS transistors of the cascode assembly have identical sizes.

5. The circuit of claim 1, wherein the resistor the first branch of the bipolar assembly is of same value as a first resistor of the second branch which has a common terminal with the resistor of the first branch, the bipolar transistor connected in series with the two resistors being of greater size than the other bipolar transistor.

6. The circuit of claim 1, wherein the mirror assembly comprises a third branch formed of two P-channel MOS transistors in series with a current-to-voltage conversion resistor between said high and low supply rails, the voltage across said conversion resistor being directly proportional to the internal temperature of the integrated circuit.

7. The circuit of claim 1, wherein the mirror assembly comprises a third branch formed of two P-channel MOS transistors n series Th a current-to-voltage conversion resistor between said highand low supply rails, the voltage across said conversion resistor being directly proportional to the internal temperature of e integrated circuit wherein the respective gates of these two MOS transistors of the third branch are connected to the respective gates of the two MOS transistors of the first branch.

8. An integrated digital temperature sensor, comprising:

the circuit for generating a reference voltage and a voltage proportional to the internal temperature of claim 6;

a calibration circuit exploiting the reference voltage and the voltage proportional to temperature, to provide two voltages representative of high and low conversion thresholds, and an analog voltage representing the current temperature; and an analog-to-digital converter receiving the three voltages provided by the calibration circuit, and providing a binary word representative of the internal circuit temperature.

9. The sensor of claim 8, wherein said voltage representative of the low conversion threshold is formed by the reference voltage.

10. The sensor of claim 8, wherein the output of the analog-to-digital converter is connected to the input of a register for storing the digital temperature.

11. A circuit for generating a bandgap reference voltage, comprising:

a current mirror assembly of cascode type comprising at least two parallel branches of MOS transistors;

a bipolar assembly in series with one of the two parallel branches of the mirror assembly; and a differential amplifier for balancing the currents in the two branches of the bipolar assembly, the reference voltage being provided by a terminal of interconnection of the mirror assembly with the bipolar assembly.

12. The circuit of claim 11, wherein said mirror assembly comprises:

a first branch formed of two series diode-connected transistors; and a second branch formed of two transistors in series having their respective gates connected to the respective gates of the two transistors of the first branch, the second branch forming the branch in series with the bipolar assembly.

13. The circuit of claim 12, wherein respective inputs of the differential amplifier are connected to respective branches of the bipolar assembly, an output of the differential amplifier being connected to the terminal of the first branch of th cascode assembly.

14. The circuit of claim 12, wherein the four MOS transistors of the cascode assembly have identical sizes.

15. The circuit of claim 11, wherein a first resistor of the first branch of the bipolar assembly is of a same value as a second resistor of the second branch which has a common terminal with the first resistor of the first branch and a third resistor in series with the second resistor, a second bipolar transistor connected in series with the second and third resistors being of greater size than a first bipolar transistor in series with the first resistor.

16. The circuit of claim 11, wherein the mirror assembly comprises a third branch formed of two P-channel MOS transistors in series with a current-to-voltage conversion resistor between said high and low supply rails, the voltage across said conversion resistor being directly proportional to the internal temperature of the integrated circuit.

17. The circuit of claim 11, wherein the mirror assembly comprises a third branch formed of two P-channel MOS transistors n series with a current-to-voltage conversion resistor between said high and low supply rails, the voltage across said conversion resistor being directly proportional to the internal temperature of the integrated circuit wherein the respective gates of these two MOS transistors of the third branch are connected to the respective gates of the two MOS transistors of the first branch.

* * * * *

UNITED STATES PATENT AND TRADEMARK OFFICE

CERTIFICATE OF CORRECTION

PATENT NO. : 6,946,825 B2 
DATED : September 20, 2005
INVENTOR(S) : Franck Duclos, Olivier Ladiray and Jérôme Heurtier It is certified that error appears in the above-identified patent and that said Letters Patent is hereby corrected as shown below:

Column 8,
Line 29, should read:
-- 5. The circuit of claim 1, wherein the resistor of the first --.
Line 43, should read:
-- transistors n series with a current-to-voltage conversion resis --.
Line 46, should read:
-- internal temperature of the integrated circuit wherein the --.

Column 9,
Line 25, should read:
-- internal temperature of the integrated circuit wherein the --.

Signed and Sealed this

Tenth Day of January, 2006

JON W. DUDAS
*Director of the United States Patent and Trademark Office*

UNITED STATES PATENT AND TRADEMARK OFFICE

CERTIFICATE OF CORRECTION

PATENT NO. : 6,946,825 B2
DATED : September 20, 2005
INVENTOR(S) : Franck Duclos, Olivier Ladiray and Jérôme Heurtier It is certified that error appears in the above-identified patent and that said Letters Patent is hereby corrected as shown below:

Column 9,
Line 25, should read -- branch of the cascode assembly --.

Signed and Sealed this

Twenty-first Day of March, 2006

JON W. DUDAS
*Director of the United States Patent and Trademark Office*